US011535492B2

(12) United States Patent
Romo et al.

(10) Patent No.: US 11,535,492 B2
(45) Date of Patent: Dec. 27, 2022

(54) OVERSPEED SAFETY MECHANISM FOR LIFT CAR

(71) Applicant: SafeWorks, LLC, Tukwila, WA (US)

(72) Inventors: David Arevalo Romo, Bonney Lake, WA (US); Gregory Scott McDonald, Renton, WA (US)

(73) Assignee: Safeworks, LLC, Tukwila, WA (US)

( * ) Notice: Subject to any disclaimer, the term of this patent is extended or adjusted under 35 U.S.C. 154(b) by 352 days.

(21) Appl. No.: 16/740,343

(22) Filed: Jan. 10, 2020

(65) Prior Publication Data

US 2020/0223666 A1 Jul. 16, 2020

Related U.S. Application Data

(60) Provisional application No. 62/790,921, filed on Jan. 10, 2019.

(51) Int. Cl.

| | |
|---|---|
| ***B66B 5/24*** | (2006.01) |
| ***B66B 5/04*** | (2006.01) |
| ***B66B 5/26*** | (2006.01) |
| *B66B 11/00* | (2006.01) |
| *B66B 11/04* | (2006.01) |

(52) U.S. Cl.

CPC ..... *B66B 5/24* (2013.01); *B66B 5/042* (2013.01); *B66B 5/26* (2013.01); *B66B 11/009* (2013.01); *B66B 11/0423* (2013.01)

(58) Field of Classification Search

CPC .. B66B 5/24; B66B 5/042; B66B 5/26; B66B 11/009; B66B 11/0423; B66B 5/04

See application file for complete search history.

(56) References Cited

U.S. PATENT DOCUMENTS

| | | | | | |
|---|---|---|---|---|---|
| 1,886,213 | A * | 11/1932 | Murphy | B66B 5/20 | 187/370 |
| 3,386,530 | A * | 6/1968 | Thompson | B66B 5/24 | 188/65.1 |
| 3,586,125 | A * | 6/1971 | Durand | B66D 5/16 | 182/92 |
| 3,695,396 | A * | 10/1972 | Jones | B66B 5/18 | 187/373 |
| 4,029,177 | A * | 6/1977 | Fiss | B66B 5/24 | 188/188 |
| 4,106,753 | A * | 8/1978 | Cavalieri | B66B 5/24 | 188/188 |
| 4,254,941 | A * | 3/1981 | Tanson | B66D 5/16 | 188/65.1 |
| 4,821,842 | A * | 4/1989 | Cavalieri | B66D 1/58 | 182/19 |

(Continued)

*Primary Examiner* — Michael A Riegelman
(74) *Attorney, Agent, or Firm* — Baker Hostetler LLP

(57) ABSTRACT

An overspeed safety braking mechanism for lift cars and elevator systems is described herein. The safety mechanism may comprise a safety kit secured to an overhead portion of a lift car, and configured to engage a cable to prevent a downward movement of the lift car. Engagement of the cable may occur when a threshold speed is reached. The overhead portion of the lift car is detachable upon a predetermined upward force resulting from an engagement of the safety cable from the safety kit. A primary brake system may be positioned beneath the safety kit, on or near a lift platform, configured to engage the safety cable in response to an activation of the safety kit and a detection of the threshold speed.

19 Claims, 4 Drawing Sheets

(56) References Cited

U.S. PATENT DOCUMENTS

| | | | | |
|---|---|---|---|---|
| 10,294,076 | B2 * | 5/2019 | Wurth | B66B 5/12 |
| 2007/0007083 | A1 * | 1/2007 | Husmann | B66B 5/20<br>187/366 |
| 2015/0041256 | A1 * | 2/2015 | Okada | B66B 5/0031<br>187/254 |
| 2015/0122592 | A1 * | 5/2015 | Zhu | B66B 5/24<br>188/65.1 |
| 2016/0152442 | A1 * | 6/2016 | Weber | B66B 19/005<br>187/359 |
| 2019/0168998 | A1 * | 6/2019 | Rivero | B66B 5/185 |
| 2020/0223664 | A1 * | 7/2020 | Romo | B66B 5/18 |
| 2020/0223666 | A1 * | 7/2020 | Romo | B66B 5/185 |

* cited by examiner

OVERSPEED SAFETY MECHANISM FOR LIFT CAR

CROSS REFERENCE TO RELATED APPLICATION

This application claims benefit under 35 U.S.C. § 119(e) of Provisional U.S. patent application No. 62/790,921, filed Jan. 10, 2019, the contents of which are incorporated herein by reference in their entirety.

TECHNICAL FIELD

This disclosure relates to safety mechanisms, and more specifically to overspeed safety mechanisms for lift cars.

BACKGROUND

Hoist elevators and lift cars move people and objects vertically along a track, for example between floors or platforms of a building or other structure. These lift systems may be suspended and moved by one or more cables driven by a motor, such as a hydraulic, electric or other type of motor. Brake systems are mechanically connected to the one or more cables, and are configured to engage the cables to slow and/or stop the movement of the car.

Safety mechanisms are often installed on lift car systems as back-up systems to ensure that brakes engage in the event of a cable failure, break system failure, or other event, which may cause the lift car to fall. While such safety mechanisms may be effective in ensuring that the lift cars do not remain in a free-fall state, sudden stops following an unexpected drop can be harmful to both the lift car system and any individuals within the lift car. For example, a sudden deceleration following a period of unexpected free-fall may result in greater forces on brake system and lift car components and potential damage, if the forces are greater than the components were designed to withstand. Likewise, a sudden stop can cause injury to individuals using the lift car system, since they must absorb the force form the sudden stop. Accordingly, while safety brake mechanisms may significantly reduce and/or essentially eliminate the probability of a free fall, additional safety can reduce consequential harm from such systems.

SUMMARY

Illustrative examples of the present disclosure include, without limitation, methods, structures, and systems. In an embodiment, an overspeed safety system comprises a safety kit secured to an overhead portion of a lift car through an attachment, and a brake system positioned beneath the safety kit. The safety kit is configured to engage a safety cable to slow a downward movement of the lift car when a threshold speed is reached, and the overhead portion of the lift car is detachable form the lift car upon a predetermined upward force resulting from an engagement of the safety cable by the safety kit. The brake system may be positioned beneath the safety kit and configured to engage the safety cable and at least one support cable to prevent a downward movement of the lift car, in response to at least one of an activation of the safety kit, and a detection of the threshold speed.

In embodiments, the overhead portion is detachable at one or more points above a working area of the lift car, and a predetermined force. In various embodiments, the safety kit may be configured to receive one or more cables (e.g., 8, 9, 10 mm cables), and an overspeed governor system may be utilized to identify the threshold speed and engage the wire cable. The safety kit may further comprise one or more manual controls to activate, reset, lock, unlock, or test the safety kit.

Other features of the methods, structures, and systems are described below. The features, functions, and advantages can be achieved independently in various examples or may be combined in yet other examples, further details of which can be seen with reference to the following description and drawings.

BRIEF DESCRIPTION OF THE DRAWINGS

A more detailed understanding may be had from the following description, given by way of example in conjunction with the accompanying drawings wherein.

DETAILED DESCRIPTION

Various aspects of the present disclosure as described herein are generally directed to an overspeed safety mechanism for lift cars, cabs, and other elevator systems. The present disclosure describes improved overspeed braking mechanisms providing additional safety features including an overspeed safety kit and a detachable canopy to prevent damage to individuals and lift car components during unexpected falls and sudden braking events.

Figure 1:
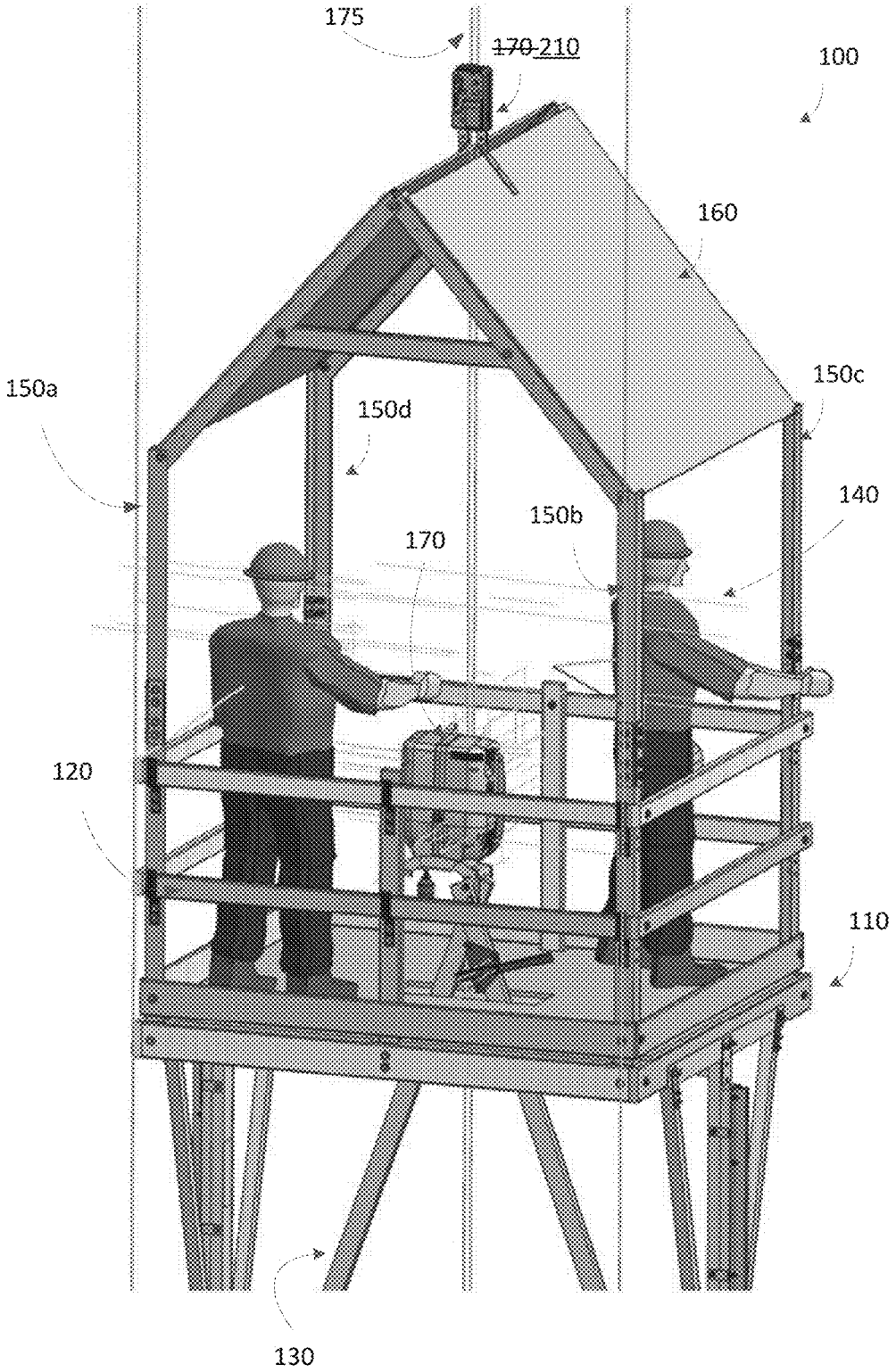
FIG. 1 illustrates an overspeed safety mechanism in accordance with one or more embodiments.

FIG. 1 is a perspective view of a lift car system comprising an overspeed brake system and safety mechanisms 100. In this example, the lift car system comprises a platform 110, which may be raised and lowered by one or more lift mechanisms, such as a motor, a hydraulic lift, traction hoist, or other device. In an embodiment, the powered movement of support beams 130 beneath the platform may initiate the vertical movement of the platform. In other embodiments, one or more cables attached to the platform may be used to raise and lower the platform using a motor. Any variety of systems and methods may be used or combinable to raise and lower the platform.

The platform 110 provides an area for one or more individuals 140. A plurality of guardrails 120 may be present to protect individuals on the platform and reduce the likelihood of falling off. As illustrated in FIG. 1, a metal post 150 may be positioned at each corner of the platform (see 150 *a-d*), to connect a plurality, e.g., four, beams that support an overhead canopy 160 above the working area. Various materials may be used for the beams, such as steel or stainless steel, and the overhead canopy may be comprised of wood, such as plywood, metal, or another such material with the properties to accomplish the functions as described herein below. It will also be appreciated that a canopy may comprise any style, design, or type of overhead portion of the lift car system, including but not limited to a roof, awning, shade, scaffold, frame, support, beams, bars, etc.

An overspeed safety kit 210 170 may be provided at the top of the canopy 160, aligned with one or more cables associated with a brake system. In embodiments, the brake system may be located on or near the platform, or in an area easily accessible to the one or more individuals on the platform. The overspeed safety kit 210 170 is securely attached to a top portion of the canopy 160, and assists in engaging the braking system during a fall or other situation where a threshold speed is detected. In various embodiments, the safety kit accomplishes this by engaging a safety cable that is also connected to the braking system. As described in more detail with respect to FIGS. 2-4, the overspeed safety kit may identify an excessive, e.g., threshold, speed, based on the movement of a cable through the safety kit as the platform is vertically moved, and the safety kit may engage the safety cable to stop a downward movement once the threshold speed is reached. The safety cable engagement may subsequently trigger a mechanical reaction in the brake system 170 to engage the brakes, secure one or more cables associated with the lift car, and stop the lift from falling to the ground.

The overspeed safety kit's secure attachment to the canopy 160 provides an additional safety measure to protect individuals on the platform during a free fall. The canopy 160 is designed to break apart from the rest of the platform 110 when a predetermined threshold force is upwardly applied. For example, during an engagement of the safety kit during a free fall, the upward force on the canopy 160 due the sudden deceleration from braking may be the predetermined force necessary to disconnect the canopy from the rest of the platform. In an embodiment, the canopy breaks off at its connection points with the top of the posts 150 *a-d*. In other embodiments, the breaking points may be elsewhere depending on the size, shape, and configuration of the platform. In embodiments, the canopy may be easily reattached after a detachment during a sudden braking event. Any of a variety of mechanisms may be utilized to easily detach components upon a predetermined force, and to reattach the components for subsequent use.

This breaking feature protects individuals working on the platform, by ensuring that the canopy 160 does not collapse or fall onto them at any point during a fall or the subsequent braking. In one example, the canopy's attachment, e.g., the connection points to the posts 150 in FIG. 1 may not be designed to withstand the sudden deceleration and force required to bring a free-falling platform to rest. If the canopy's support is not strong enough to withstand such forces, the canopy can break and continue falling onto the individuals on the platform. This can cause significant injury to the individuals, as well as damage to the platform itself. Pieces of the canopy may even continue to fall beyond the platform, harming individuals on the ground, and causing even more damage. The safety kit's attachment solves this problem by preventing the canopy from continuing to fall after a sudden deceleration during breaking. When the overspeed safety kit 210 engages the safety cable 175, an upward force is applied to the canopy as the safety kit slows down the fall. If this force is greater than the strength of the connection to the platform posts, then the canopy will break off. Accordingly, when the braking system subsequently engages to stop the platform's fall, the canopy will not continue to fall onto the individuals.

In embodiments, the strength of the safety kit's attachment to the canopy should be stronger than the canopy's attachment to the posts. This ensures that the canopy 160 does not detach from the safety kit 170, and thus risk a collapse onto the platform 110 and individuals 140. The material of the canopy may be a wood, such as plywood, metal, or another material selected to withstand an upward force from the safety kit to detach from the platform, and to optimize the intended use of the lift system. It will be appreciated that the size, shape, design, and material of the canopy are not limited to the descriptions and illustrations described herein. Any variety of materials, designs, strengths, and configurations may be selected based on considerations including, but not limited to, a type of lift system its intended use of the lift system, location (e.g., inside/outside), design, etc.

Another benefit of a detachable canopy may be illustrated in an example situation where individuals may be secured or harnessed to an external feature outside of the platform, or a separate cable for additional stability and security while working. In the event of a platform collapse or a free fall of the lift system, the platform and canopy will continue to fall until the safety kit and/or brake systems engage, and the individual's fall may be stopped based on the cable or feature to which they are attached. However, if the individual's fall is stopped prior to the platform and canopy, the canopy portion will continue to fall onto the individuals, and may cause significant injury. The overspeed safety kit's attachment to the canopy is designed to ensure that the canopy will break off once a predetermined force is reached, e.g., the braking force during engagement of the safety cable to the wire, in order to prevent the canopy from falling onto or hitting the individuals.

Figure 2:
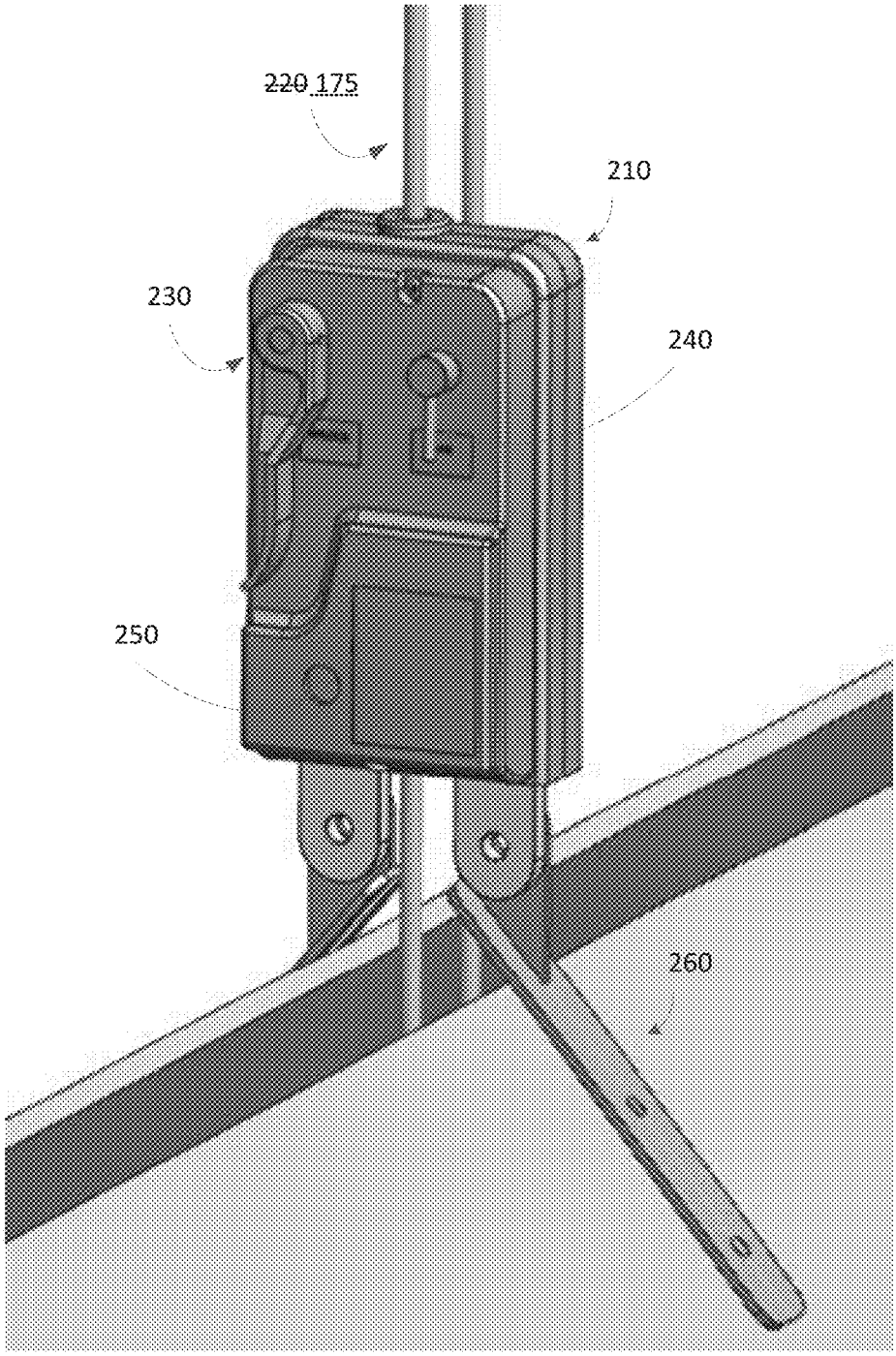
FIG. 2 illustrates a safety kit installed on an overhead portion of an elevator lift.

FIG. 2 illustrates an overspeed safety kit installed onto the canopy and receiving a safety cable. The safety kit 210 may comprise one or more levers or switches that allow a manual activation and resetting of the overspeed safety kit. After engagement of safety cable 175, the safety kit may require a manual activation of lever 230, to disengage the cable and reset the device for subsequent use. In some embodiments, a manual unlocking action is not necessary to reset the device. In one example, an upward movement of the lift car may mechanically rest the safety kit for a subsequent use. A lock lever 240 may also be present and may be manually-activated to physically engage the cable. This may be desired for manual testing, to ensure that the platform is stabilized in a particular raised position, and other purposes. In embodiments, the safety kit may provide a view hole 250 to the inside of the safety kit, so one can visually inspect the safety kit 210 and ensure that there are no visible physical issues present.

The illustrated safety kit receives a single cable, e.g., a steel wire cable, to engage during an overspeed situation. The cable may be 8, 9, or 10 mm in diameter, depending on the total weight and load of the lift car. It will be appreciated that cables of any of a variety of sizes and materials may be used based on the lift car weight, system requirements, and other considerations. Likewise, the safety kit is not limited to use with only a single cable. Two, three, or any of a plurality of cables may be utilized and the safety kit adapted to accommodate and engage such cables, depending on system configurations and intended use.

As discussed above, the safety kit is secured to the canopy using one or more attachments 260. The attachment 260 may be metal, comprise one or more parts, and connect to a bottom portion of the safety kit. In embodiments, the canopy attachment may be a part of the safety kit, or separate from the safety kit. The attachment must be secure enough to at least withstand the weight of the canopy, as well as a deceleration force required to accomplish its intended function of detaching the canopy from the rest of the platform in response to an excessive force, e.g., braking after a free fall, and preventing the canopy from falling onto one or more individuals below. In other words, the safety kit's attachment to the overhead portion may withstand a force greater than a connection strength between the overhead portion and the lift car.

Figure 3B:
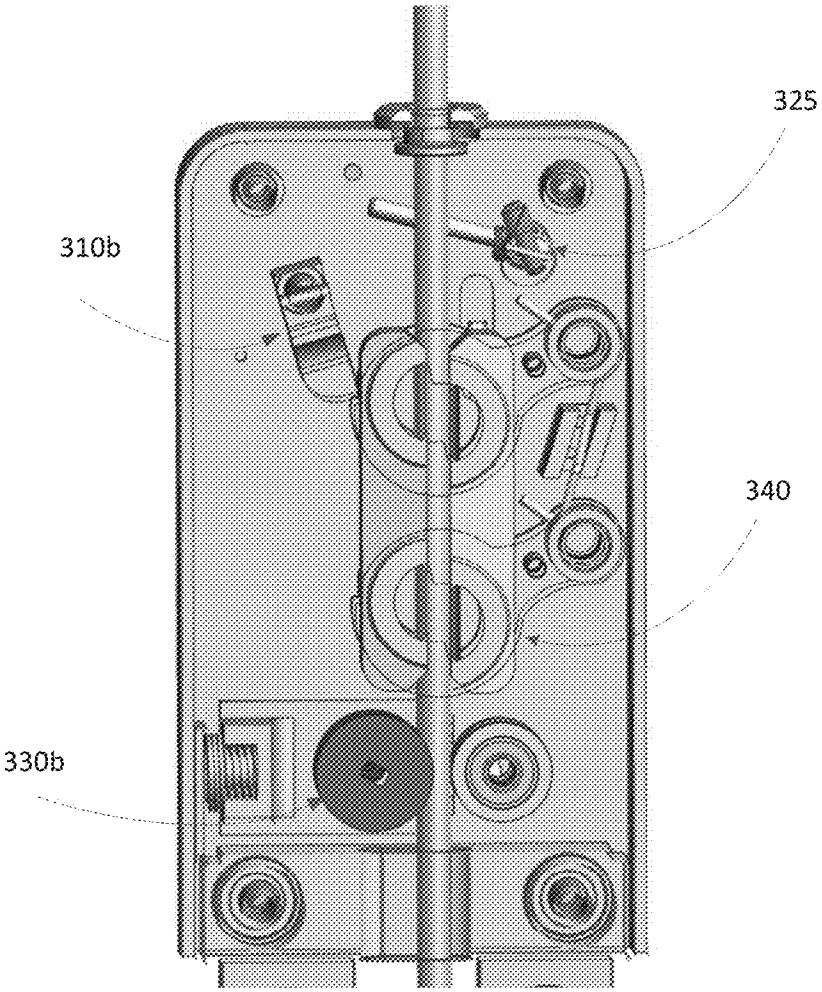
FIG. 3B illustrates another rear cross-sectional view of the safety kit, including the cable engagement mechanisms.
Figure 3A:
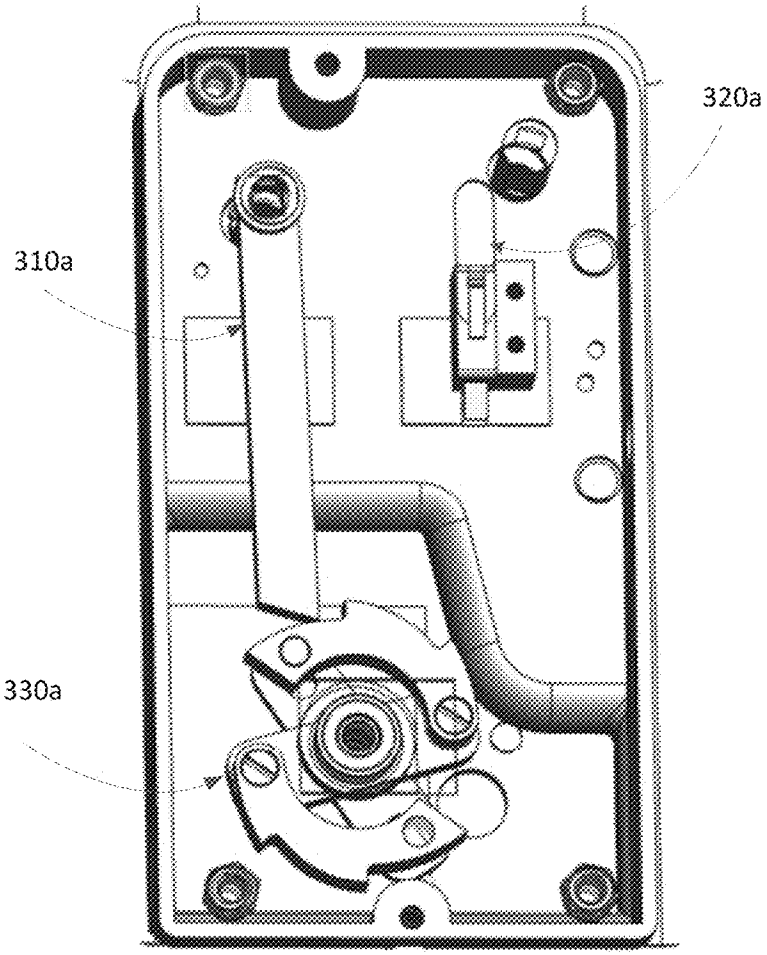
FIG. 3A illustrates a rear cross-sectional view the safety kit, including the manual activation mechanisms.

FIGS. 3A and 3B depict cross-sectional rear views of the overspeed safety kit as described herein. FIG. 3A illustrates mechanism behind a manual engagement of the manual lock/unlock levers of the safety kit, while FIG. 3B more clearly depicts a cable engagement mechanism. From this perspective, FIG. 3A comprises a layer beneath FIG. 3B. With reference to both FIGS., gear 330 is directly associated with the movement of the safety cable, and by extension, the vertical movement of the lift car. The gear may be positioned to rotate as the safety cable passes in either direction, up or down. In one embodiment, the gear 330 may be configured to rotate clockwise while the lift car is going up (i.e., the cable is moving downwards through the safety kit) and counter-clockwise during a downward movement of the car. When the lever 310 *a, b*, is engaged, as depicted, gear 330 is prevented from rotating counter-clockwise. That is, the gear is locked during a downward movement of the lift car. The gear 330 is in turn, directly linked to an engagement of the cable through engagement mechanism 340. As the gear is locked, the engagement mechanism 340, clamps onto the cable to prevent additional movement. This may trigger and/or assist the brake system, as disclosed herein, and prevent the lift car from moving downward.

Similarly, the unlock lever 320 resets the overspeed safety kit, in order to allow movement of the car in both directions. During an engagement of the unlock lever, pin 325 is reset, which triggers a release of the engagement mechanism 340, and allows normal operation. Then, during a subsequent overspeed event, such as fall, or any event which exceed the threshold speed, the lock mechanism may become automatically engaged, and thus trigger an engagement of the cable engagement mechanism, as described above. It will be appreciated that this is only one example of a safety kit and its lock/unlock mechanisms. Overspeed safety kits are not limited to the depicted mechanical embodiment, and the present figures are provided for illustrative purposes only. They are not meant to be limiting in any way.

Figure 4:
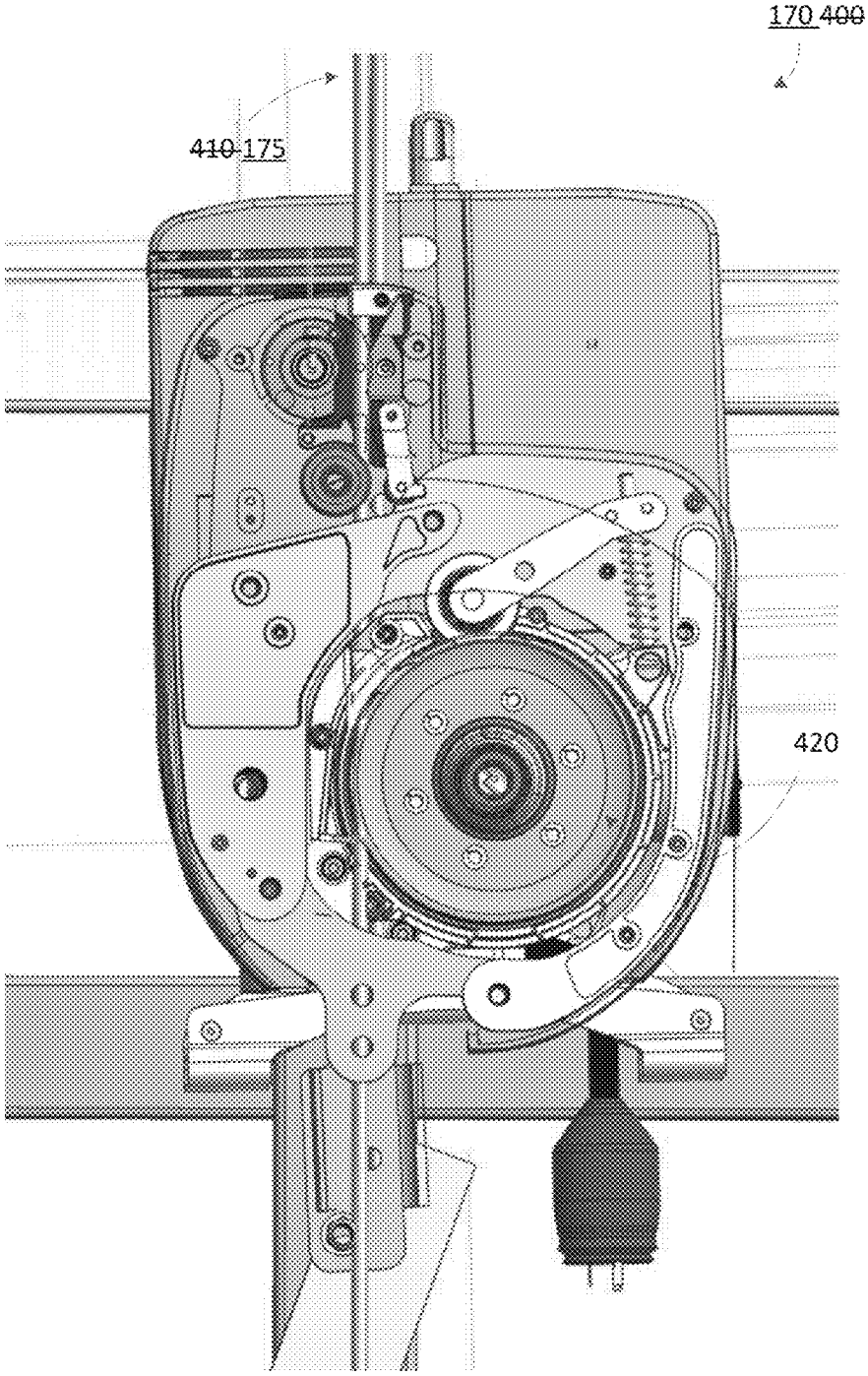
FIG. 4 illustrates a cross-sectional view of a brake system in accordance with one or more embodiments.

FIG. 4 depicts a cross-sectional view of an example brake system 170, which may be used in accordance with one or more embodiments. In this embodiment, as illustrated in FIG. 1, the brake system may receive safety cable 175 from the overspeed safety kit, as well as one or more support cables attached to and capable of supporting the lift system. An engagement of the safety cable 175 by the overspeed safety kit, as discussed with respect to FIG. 3, may trigger and/or assist one or more gears and levers in the brake system to physically engage the one or more safety and support cables to slow and ultimately stop a downward movement of the lift car.

In one example, the brake system may also detect an excessive speed indicative of a free fall, and may activate a lever to trigger a primary braking mechanism 420, to clasp, and slow movement of the lift car system. The brake system may comprise a variety of designs and mechanisms known in the art, such as a governor system and mechanism to initiate braking. Likewise, the precise positioning and location of the braking system relative to the platform and lift car may vary based on design considerations. In some embodiments, the braking mechanism may be assisted by a motor or other electrical power assist in braking. In other embodiments, the braking system and a motor to vertically move the platform may be in a single device or separate devices.

In general, the various components and processes described above may be used independently of one another, or may be combined in different ways. All possible combinations and sub-combinations are intended to fall within the scope of this disclosure. The example systems and components described herein may be configured differently than described. For example, elements may be added to, removed from, or rearranged compared to the disclosed examples.

While different figures may represent alternate embodiments, identical element numbers used in different figures are intended to represent similar elements. Additionally, while certain examples or illustrative examples have been described, these examples have been presented by way of example only, and are not intended to limit the scope of the subject matter disclosed herein. Indeed, the novel methods and systems described herein may be embodied in a variety of other forms. The accompanying claims and their equivalents are intended to cover such forms or modifications as would fall within the scope and spirit of certain subject matter disclosed herein.

What is claimed:

1. An overspeed safety system for a lift car, comprising:

a safety kit secured to an overhead portion of a lift car, wherein the safety kit is configured to engage a safety cable to slow a downward movement of the lift car when a threshold speed is reached, and the overhead portion is detachable from the lift car upon a predetermined upward force resulting when the overhead portion decelerates faster than the lift car;

an attachment securing the safety kit to the overhead portion of the lift car; and a brake system positioned beneath the safety kit, configured to engage the safety cable and at least one support cable to prevent a downward movement of the lift car, in response to at least one of an activation of the safety kit and a detection of the threshold speed.

2. The system of claim 1, wherein the overhead portion is detachable at one or more points above a working area of the lift car.

3. The system of claim 1, wherein the safety kit comprises one or more manually activated levers to engage or disengage the safety cable.

4. The system of claim 1, wherein the predetermined upward force is greater than a connection strength between the overhead portion and the lift car.

5. The system of claim 1, wherein the attachment comprises a metal and forms a bottom part of the safety kit.

6. The system of claim 1, wherein the safety cable is 8, 9, or 10 mm in diameter.

7. The system of claim 1, wherein the overhead portion is a canopy comprising at least one of wood and metal.

8. The system of claim 1, wherein at least one of the safety kit and brake system utilizes an overspeed governor to detect the threshold speed and engage the safety cable.

9. The system of claim 1, wherein the lift car is raised and lowered using a hydraulic lift or traction hoist.

10. An overspeed safety method for a lift car connected to one or more cables, comprising:

engaging a safety cable with a safety kit when a threshold speed is reached to slow a downward movement of the lift car, wherein the safety kit securely attaches to an overhead portion of the lift car engages the cable when the threshold speed is reached, and wherein the overhead portion detaches from the lift car upon a predetermined upward force resulting from the overhead portion decelerates faster than the lift car;

engaging the safety cable and at least one support cable, using a brake system positioned beneath the safety kit, in response to at least one of an activation of the safety kit and a detection of the threshold speed.

11. The method of claim 10, further comprising detaching the overhead portion at one or more points above a working area of the lift car when the predetermined upward force is reached.

12. The method of claim 10, further comprising manually activating one or more levers on the safety kit to engage or disengage the safety cable.

13. The method of claim 10, wherein the predetermined force is a braking force of the engagement of the safety kit to the safety cable.

14. The method of claim 10, wherein the predetermined force is greater than a connection strength between the overhead portion and the lift car.

15. The method of claim 10, further comprising detecting the threshold speed using an overspeed governor.

16. The method of claim 10, further comprising using a hydraulic lift or traction hoist to raise and lower the lift car.

17. The method of claim 10, further comprising reattaching the overhead portion following a detachment.

18. The method of claim 10, wherein detachment of the overhead portion prevents the overhead portion from reaching a working area or platform of the lift car.

19. The method of claim 10, wherein the safety kit's attachment to the overhead portion can withstand a force greater than a connection strength between the overhead portion and the lift car.

* * * * *